US008286398B2

(12) United States Patent
Fearn

(10) Patent No.: US 8,286,398 B2
(45) Date of Patent: Oct. 16, 2012

(54) MONOPOUR FORM

(76) Inventor: Richard Fearn, Surrey (CA)

( * ) Notice: Subject to any disclaimer, the term of this patent is extended or adjusted under 35 U.S.C. 154(b) by 100 days.

(21) Appl. No.: 12/503,499

(22) Filed: Jul. 15, 2009

(65) Prior Publication Data

US 2010/0011698 A1 Jan. 21, 2010

Related U.S. Application Data

(60) Provisional application No. 61/129,723, filed on Jul. 15, 2008.

(51) Int. Cl.
*E04B 1/16* (2006.01)

(52) U.S. Cl. ..... 52/294; 52/292; 52/426

(58) Field of Classification Search ..... 52/294, 52/309.9, 309.11, 309.12, 426, 742.14, 169.9, 52/292, 293.1, 293.2, 293.3, 295, 296, 297, 52/298, 299

See application file for complete search history.

(56) References Cited

U.S. PATENT DOCUMENTS

| | | | | |
|---|---|---|---|---|
| 3,561,175 | A * | 2/1971 | Best et al. | 52/169.11 |
| 3,667,237 | A * | 6/1972 | Dougan | 405/264 |
| 3,688,457 | A * | 9/1972 | Sherno | 52/169.11 |
| 4,600,459 | A * | 7/1986 | Proctor | 156/212 |
| 5,224,321 | A * | 7/1993 | Fearn | 52/741.15 |
| 5,459,971 | A * | 10/1995 | Sparkman | 52/426 |
| 5,495,696 | A * | 3/1996 | Repka | 52/169.5 |
| 5,794,393 | A * | 8/1998 | Fearn | 52/294 |
| 5,836,126 | A * | 11/1998 | Harkenrider et al. | 52/410 |
| 5,896,714 | A | 4/1999 | Cymbala | 52/426 |
| 6,076,320 | A * | 6/2000 | Butler | 52/294 |
| 6,216,403 | B1 * | 4/2001 | Belbeoc'h | 52/223.13 |
| 6,240,700 | B1 * | 6/2001 | Sheu | 52/741.13 |
| 6,343,894 | B1 * | 2/2002 | Fearn | 405/233 |
| 6,568,141 | B2 * | 5/2003 | Kremers | 52/426 |
| 6,718,716 | B2 * | 4/2004 | Cowie | 52/404.1 |
| 7,226,033 | B2 * | 6/2007 | Foucher et al. | 249/44 |
| 7,549,263 | B1 * | 6/2009 | Porter | 52/794.1 |
| 8,011,158 | B1 * | 9/2011 | Powell | 52/742.14 |
| 2001/0004819 | A1 * | 6/2001 | Reymann | 52/426 |
| 2001/0029717 | A1 * | 10/2001 | Spakousky | 52/405.4 |
| 2002/0139073 | A1 * | 10/2002 | Morello | 52/294 |
| 2003/0168575 | A1 * | 9/2003 | Fearn et al. | 249/18 |
| 2004/0128922 | A1 * | 7/2004 | Fearn | 52/169.13 |
| 2007/0044405 | A1 * | 3/2007 | Straub et al. | 52/309.11 |
| 2007/0056226 | A1 * | 3/2007 | Angelo | 52/169.9 |
| 2007/0056227 | A1 * | 3/2007 | Angelo | 52/169.9 |
| 2007/0068100 | A1 * | 3/2007 | Fearn | 52/292 |
| 2007/0294970 | A1 * | 12/2007 | Marshall et al. | 52/309.11 |
| 2008/0083190 | A1 * | 4/2008 | Fearn | 52/651.07 |
| 2009/0313914 | A1 * | 12/2009 | Kovatch et al. | 52/79.11 |
| 2011/0214376 | A1 * | 9/2011 | Jaycock | 52/396.03 |

FOREIGN PATENT DOCUMENTS

DE 2062998 A1 * 7/1972

* cited by examiner

*Primary Examiner* — Basil Katcheves
*Assistant Examiner* — Rodney Mintz

(57) ABSTRACT

A monopour foundation form has a flexible sheet form element having longitudinal edge portions and a contact portion, with the contact portion supported directly on the ground and oriented in the direction of the foundation axis. Transverse wall form supports supported directly on the flexible sheet form element, spaced apart and centered over the foundation axis, support a wall form assembly in a position above the ground. Edge portions of the flexible sheet form element are secured to the lower portions of the wall form panels thereby forming a general U-shape and extending longitudinally under the wall form assembly. A concrete mix fills the flexible sheet form element and interior portion of the wall form assembly, simultaneously forming the footing and wall.

1 Claim, 7 Drawing Sheets

MONOPOUR FORM

CROSS REFERENCE TO RELATED APPLICATIONS

This application claims priority under 35 U.S.C 119(e) to Richard Fearn's U.S. Provisional Patent Application No. 61/129,723 filed on Jul. 15, 2008 entitled Footing and Wall Monopour Form Using Fabric, the disclosure of which is incorporated herein by reference.

FIELD OF THE INVENTION

This invention relates generally to a concrete footing and wall form wherein the footing and wall forms are poured at the same time.

DISCUSSION OF RELATED ART

Poured concrete foundations for buildings have been used for many years and usually require disposable formwork such as lengths of lumber and plywood sheets, which are temporarily installed on the ground or site surfaces in two stages. First the footing forms are installed by driving pairs of stakes in the ground at about eight feet on center, and then nailing pairs of dimensional lumber, for example 2×10s to the stakes in a horizontal position to form the footing. This process is time consuming and labor intensive, and often the soil is difficult to drive stakes. A concrete pump and truck is required to fill up the footing forms, and labor is required to screed the top of the concrete to make it level. Lumber and stakes must be removed the following day which requires more labor and considerable time. Damaged lumber must then be disposed of which is bad for the land fills.

Wall forms are set up on top of the poured footing, braced, and filled with concrete. The concrete pump is required a second time which adds greatly to the expense of the foundation. Both types of foundation formwork described above use lengths of lumber and plywood sheets which, after stripping from the set concrete, are contaminated with concrete and thus are usually unsuitable for use elsewhere in the building, except perhaps in low-grade or temporary construction work. Consequently, when constructing conventional concrete foundation forms, there is usually a high labor input both in installing the forms and stripping the forms after pouring the concrete, and there is also high wastage of form material when the poured foundation has been stripped.

U.S. Pat. No. 5,224,321 discloses an earlier invention of the present applicant in which a foundation form assembly is secured to a temporarily supported prefabricated floor assembly. The foundation form assembly extends downwardly from the floor assembly towards a building site surface which supports jacks which in turn temporarily support the floor assembly. The form assembly comprises inner and outer rigid sheet panels which serve as upper forms and are connected to the floor assembly. Lower portions of the rigid sheet panels are connected to upper edges of a flexible fabric sheet lower form element which rests on the site surface and extends as a generally U-shaped elongated container between the inner and outer sheet forms. The flexible fabric sheet form conforms to undulations of the site surface when it receives a flowable concrete mixture, and thus accommodates variations in height between the form and the site surface, thus reducing work required to prepare the site surface. Form ties extend between the inner and outer rigid forms to restrict movement thereof and to resist forces from the concrete before it sets. The poured concrete has an upper surface in contact with the floor assembly to provide permanent support therefore. When the concrete sets, the jacks are removed and the outer rigid sheet forms can be removed or can remain in place. This patent discloses a flexible sheet form element which provides a footing to accommodate site undulations and slope, and while it has many advantages over prior art foundation structures, the time for installing and leveling the prefabricated floor assembly and attaching the rigid sheet forms thereto increases the cost of both materials and labor when compared with the present invention.

Insulated concrete forms have gained popularity recently. The Insulating Concrete Form Association, for example promotes usage of the technology. For background regarding insulating concrete form systems, the reader is directed to U.S. Pat. No. 5,896,714 to Cymbala issued Apr. 27, 1999, the disclosure of which is incorporated in its entirety by reference, which describes starting in the first paragraph of the background of the invention that "Insulating Concrete Form Systems ("ICFS") are known which act as a form to contain the fluid concrete while it solidifies, and also provide insulation for the finished structure. ICFS utilize a plurality of individual units or blocks, assembled in an interlocking arrangement, to create the forms for the concrete walls. Each block comprises a pair of formed plastic panels, which are held together with a plurality of ties. The ties are trust-like and comprise flange portions which reside within the foam panels and an intermediate web portions connecting the flange portions, thus securing and holding the panel portions."

Four of the references discussed below use a flexible fabric sheet form element which permits the footing to conform to the site surface. German Patent Publication 2062998, in which the applicant is Beton-U. Monierbau A G, discloses several embodiments of poured concrete foundations in which a flexible fabric sheet form is located adjacent or beneath a temporarily supported component, and thus resembles to some extent the device of the above patent. In one embodiment, upper edges of the fabric sheet form are connected to the component to provide an elongated container below the component to receive flowable concrete, which when set supports the component. The sheet form assumes a shape determined to some extent by optional stiffeners positioned within the form, but not connected thereto, or other constraints located externally of the sheet form. This invention is particularly applicable for providing foundations for structure to be supported above a body of water.

U.S. Pat. No. 5,794,393 discloses a prefabricated building foundation form assembly which is installed beneath a premanufactured building floor which is temporarily supported in its final position. The form assembly comprises a plurality of form stiffeners which extend downwards from the floor to support fabric wall forms and a fabric footing. However this invention requires the installation of a premanufactured building floor so that the invention can be suspended.

U.S. Pat. No. 6,343,894 discloses a building foundation form apparatus and method that uses reusable transverse form supports supported directly on the ground which carry longitudinal form supports onto which is stapled a flexible sheet form element which forms the concrete footing. With this disclosure the foundation wall is poured after the transverse form supports have been removed, therefore there is considerable additional expense in have the two separate pours of the concrete footing and then the concrete wall.

Four of the references discussed above use a flexible fabric sheet form element which permits the footing to conform to the site surface. However all of the references require various external assemblies to support the fabric formwork in position relative the ground. In these references, when unrestrained lowermost portions of the flexible sheet form hold fluid concrete, a contact portion of the fabric sheet form is forced into contact with the ground and, when the concrete is solidified carries weight of the building. However none of the four references allow simultaneous pouring of the wall and footing without the addition of an external assembly to hold the sheet form element in position.

SUMMARY OF THE INVENTION

The footing form is made of fabric and is attached to the lower edge portions of a concrete wall form supported by transverse wall form supports. When a flowable and settable foundation material is poured into the interior of the wall form, a footing is formed under the preinstalled wall form.

The invention reduces the difficulties and disadvantages of the prior art by providing a building foundation form apparatus which does not require the installation of a premanufactured floor assembly nor other external form elements such as transverse form elements which must be removed once the flowable and settable foundation mixture has hardened.

Installation costs are reduced because the invention allows the foundation wall and footing to be poured at the same time; the industry term is 'monopour'. Simultaneous forming of the footing and the wall is a key feature of this invention. Mono means single and Monopour is defined as: a single pouring. Monopour form is defined as: a form that can receive a single pouring.

This method costs less for four reasons: first, the concrete pump and concrete ready mix truck are called out once, not twice. Second, no footing forming lumber or stakes are required nor the labor to install and strip the lumber and stakes. Third, no labor is required to screed the concrete footing flat so that the wall forms can be installed on top. Finally, one to two days time savings are achieved when monopouring the footings and walls over the conventional two stage forming method.

The building foundation form apparatus according to the invention comprises a flexible sheet form element in contact with the ground such that the contact portion of the sheet form element between the edge portions is aligned along the foundation axis, at least first and second transverse wall form supports adapted to be supported directly on top of the flexible form sheet, and the at least one wall form assembly adapted to be centered over the foundation axis and supported by the wall form supports. The edge portions of the flexible sheet form element are attached to the lower edge portions of the wall form assembly.

The invention uses a flexible sheet form element to form the foundation footing, the two edge portions of which are supported lengthwise by the two lower edge portions of the wall form element. The lower portions of the flexible sheet form element can deform to accommodate undulations in the building site surface and sloping sites to a far greater degree than those that can be accommodated using conventional lumber footing forms and thus requires minimal excavation.

The wall form assembly is known in the industry as 'ICF' (insulated concrete form). The assembly typically consists of two panels: an inner wall form means and an outer wall form means, made of insulating foam typically 48" long, 16" high, and 2½" thick. The panels are held an exact distance apart by a plurality of form tie means manufactured of plastic or steel. Each form tie means is designed to withstand the hydraulic pressure of the liquid concrete. The concrete between to two wall form means hardens to become the concrete wall. The wall form means are left in place to insulation the concrete wall.

When the concrete is set, the wall form supports are sacrificed inside the concrete along with the flexible sheet form element which provides damp proofing for the footing concrete.

A building foundation form apparatus according to the invention comprises at least first and second wall form supports, a wall form assembly, and a flexible sheet form element wherein the two longitudinal edges are attached to the bottom edges of the wall form. The wall form support elements are purpose designed to support the form tie means of the wall form assembly so that the wall form assembly is suspended above the ground a distance equal to the desired depth of the concrete footing.

Each wall form support element consists of a base to rest on the ground and at least one upright element which is threaded to allow for adjustment of a form tie support means or webclip element which supports the tie of the wall form assembly. A nut on each threaded upright allows for the webclip to be adjusted in a vertical direction, thereby allowing the wall form assembly height to be varied so that the footing height under the wall form assembly can be obtained and so the wall form can be oriented in a horizontal direction.

The threaded shaft element is very important to this invention as it allows the wall form assembly to be adjusted vertically so that the top of the wall form assembly is level. This adjustment is possible by either turning the threaded rod inside the nut (thereby raising the nut and form tie support means vertically) or by turning the nut around the fixed threaded shaft and raising the form tie support means vertically.

The first and second wall form supports are adapted to be supported directly flexible sheet form element, which is itself on the ground. The wall form supports are longitudinally spaced apart along a longitudinal foundation axis. The flexible sheet form element has first and second longitudinally extending edge portions and a contact portion to the ground located between the edge portions. Transverse spacing between the edge portions defines width of the sheet form element when flattened. The first and second edge portions are securable to the two lower edge portions of the inner wall form means and the outer wall form means respectively. In this way, the sheet form element is supportable partially by the lower edge portions of each wall form means and can lie substantially along the foundation axis. The width of the sheet form element is such that most of the contact portion thereof is at least partially supportable on the ground when the flexible sheet form element is deformed into a generally U-shape and receives a flowable and settable foundation mixture.

The flexible sheet form element is attached to the laterally spaced apart lower edge portions of the suspended wall form assembly at a distance of 6" or 8". With ICFs, there is not sufficient strength in the foam itself for attachment, so it is the accepted procedure to attach the edges of the flexible sheet form element to the ends of the plastic or steel ties which are embedded inside the foam panels.

The lower portion the flexible sheet form element has sufficient width to enable the element to rest upon the site surface beneath the wall form support. The foundation further comprises a mass of flowable and settable foundation material essentially filling space within the flexible sheet form element and extending vertically upwards into the wall form assembly.

A flexible sheet form element is for use in a foundation form apparatus to receive a flowable and settable concrete mixture, the flexible sheet form element comprising a flexible sheet and means to control fullness of the flexible sheet. The flexible sheet has first and second parallel longitudinally extending edges and an adjacent respective edge portion, and a contact portion located between the edge portions. The means to control fullness of the flexible sheet is to maintain adequate footing widths when the sheet is supported along the edge portions thereof to receive the foundation mixture. The means to control fullness of the sheet comprises a longitudinally extending center line disposed symmetrically of the edges of the flexible sheet and symmetrically of the contact portion, and first and second sets of longitudinal guidelines located in the first and second edge portions respectively, each set having a plurality of laterally spaced apart guidelines disposed parallel to the centre line. Each guideline of the first set is identifiable with an equivalent guideline of the second set to form a pair of equivalent guidelines which are spaced equally from the centre line.

A detailed disclosure following, related to drawings, describes apparatus and method of several embodiments of the invention, which apparatus and method are capable of expression in structure and method other than those particularly described and illustrated.

BRIEF DESCRIPTION OF THE DRAWINGS

While some of the advantages of the present invention have been set forth above, other advantages will become apparent from the description of the preferred embodiment of this invention when taken in conjunction with the accompanying drawings, in which.

Figure 1:
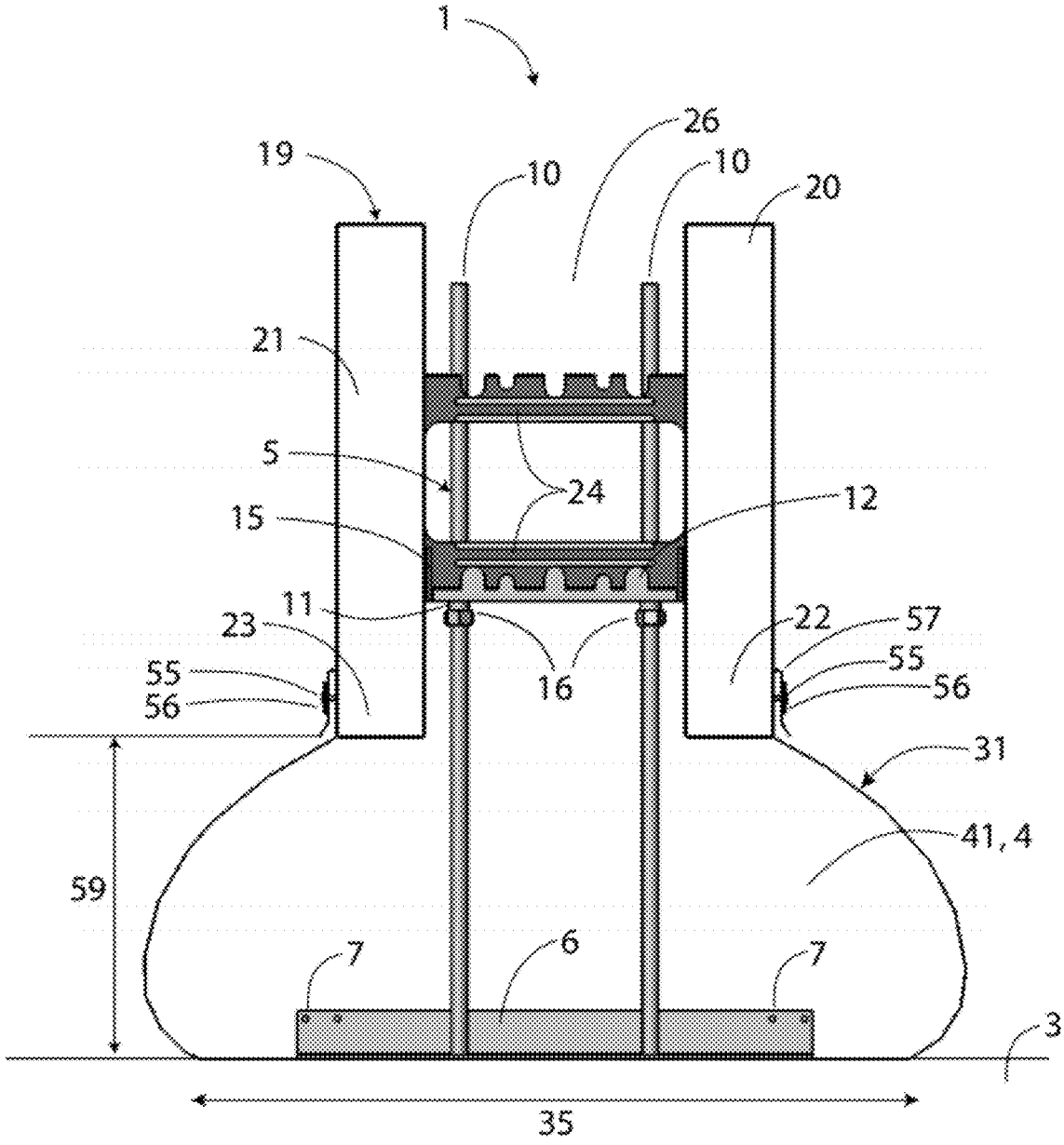
FIG. 1 is a simplified fragmented side elevation viewing of the building foundation form apparatus viewing in the direction of the foundation axis showing the flexible sheet form element in the shape that it would take when filled with the flowable and settable foundation mixture.

The following call out list of elements is presented as a reference for ease of understanding element numbering in the drawings.

| | |
|---|---|
| 1 | Building foundation form apparatus |
| 2 | Longitudinal foundation axis |
| 3 | Ground |
| 4 | Concrete footing |
| 5 | Transverse wall form support |
| 6 | Base element |
| 7 | Holes to attach steel reinforcing |
| 8 | Holes for spiking base to ground |
| 9 | Weld attachment |
| 10 | Threaded shaft element |
| 11 | Sleeve element |
| 12 | Form tie support means |
| 13 | Form tie angle means |
| 14 | Arm extension means |
| 15 | Slot for form tie means |
| 16 | Internally threaded element (nut) |
| 17 | Hole for threaded shaft element |
| 18 | Line dots |
| 19 | Wall form assembly |
| 20 | Inner wall form means |
| 21 | Outer wall form means |
| 22 | Lower edge portions (interior) |
| 23 | Lower edge portions (exterior) |
| 24 | Form tie means |
| 25 | Slots for steel reinforcing |
| 26 | Interior portion |
| 27 | Spacing |
| 28 | Corner section |
| 29 | Straight section |
| 30 | Corner wall form assembly |
| 31 | Flexible sheet form element |
| 32 | Edge portions (exterior) |
| 33 | Edge portions (interior) |
| 34 | Center portion |
| 35 | Contact portion |
| 36 | Center line |
| 37 | Footing width lines (exterior) |
| 38 | Edge lines |
| 39 | Fabric roll |
| 40 | C-folded fabric |
| 41 | Flowable and settable foundation mixture |
| 42 | Slot for rebar location |
| 43 | Feet pad elements |
| 44 | Bolt to attach feet to base element |
| 45 | Spray painted line |
| 46 | Corner diagonal line |
| 47 | Nail to fix fabric to ground |
| 48 | T-cut on inside corner |
| 49 | Equal cut on each side of 'T' |
| 50 | Corner tabs |
| 51 | Lifting fold point |
| 52 | T-cut for junction |
| 53 | T-junction tabs, run through fabric |
| 54 | Cut in intersecting fabric |
| 55 | 1-1/2" screw |
| 56 | Fender washer |
| 57 | Fold over extra fabric |
| 58 | Cut block conforming to uneven grade |
| 59 | Footing height |
| 60 | Footing width lines (interior) |
| 61 | Direction arrow on corner |
| 62 | T-junction tabs, intersecting fabric |

DETAILED DESCRIPTION OF THE PREFERRED EMBODIMENT

FIG. 1 is a simplified fragmented end elevation viewing the preferred embodiment of the building foundation form apparatus (1) in the direction of the foundation axis, showing the flexible sheet form element (31) in the profile it would take when filled with the flowable and settable foundation mixture of concrete (41).

The installation of the preferred embodiment begins with spray painting a line (45) on the ground (3) the longitudinal foundation axis (2) located directly under the center of the proposed foundation wall. The flexible sheet form element (31), which normally comes on a roll, is unrolled around the foundation perimeter, aligning the centerline of the fabric with the spray painted line. The flexible sheet form element has edge portions that are longitudinally extending and a transverse spacing between the edge portions to define a flexible sheet form element width which has a contact portion between the edge portions adapted to be supported directly on the ground and aligned along a longitudinal foundation axis.

This apparatus includes a plurality of transverse wall form supports (5) which are placed on and centered over the fabric centerline and are spaced longitudinally along this centerline to support the wall form assembly (19). Each support (5) is made up of base element (6) which sits directly on the fabric (31), at least one threaded shaft element (10), positioned vertically, and a form tie support means (12) which supports the wall form assembly (19) in position above the ground so that the distance between the underside of the wall form assembly and the ground is equal to the desired footing height (59). Support details are provided in FIGS. 2, 3, and 4.

Each wall form assembly consists of an inner wall form means (20) and an outer wall form means (21) which are typically insulated form panels of dimensions 48" long, 16" high and 2½" thick. These wall form means are spaced equidistant from each other centered over the foundation axis. Form tie means (24) are used to achieve this spacing. In the industry the form tie means are called webs and are made of plastic or steel, and are normally spaced 6" or 8" on center so that the hydraulic pressures of the concrete (41) can be withstood. The spacing between the two wall form means is 6", 8" or 10" normally. The industry name for the wall form assembly is insulating concrete form abbreviated as ICF. ICF is a common and well known abbreviation for insulating concrete form. The ICF blocks are filled with concrete and left in place to provide insulation to the foundation wall.

The inner and outer lower edge portions of the wall form means (22, 23) are used to attach the inner and outer edge portions (32, 33) of the fabric (31) thereby allowing the fabric to take a U-shape under the wall form assembly (19). The wall form means are normally made of light weight foam so the holding power is very limited. However the embedded form tie means (24) are very strong, and the fabric is attached to these. The attached fabric then takes a generally U-shape with the edge portions (32, 33) attached to the lower edge portions (22, 23) of the ICF block, and the center portion supported by the ground (3).

When concrete is placed in the interior (26) of the ICF block, the U-shaped fabric or flexible sheet form element (31) widens to have a contact width (35) with the ground (3) and thereby form the footing (4) under the ICF block. A connection between the form tie (24) and the first transverse wall form support and the second transverse wall form support hold the longitudinal wall form assemblies above the ground. In FIG. 1 the connection is a slot (15) in the form tie support (12) which supports the form tie (24) and the ICF block.

The securing means between edge portions (32, 33) of the flexible sheet form element and the lower edge portions of the rigid inner form means and the rigid outer form means are screws and fender washers. As the screw is held by a rigid plastic form tie (24), the attachment is strong enough to retain and prevent leakage of the flowable and settable foundation mixture when the foundation mixture is poured into the generally U-shaped portion of the flexible sheet form element and the interior portion (26) of the ICF blocks. The plurality of wall form assemblies at least partially support the flexible sheet form element. A portion of the flexible sheet form element also rests on the ground to form a U-shape for receiving a flowable and settable foundation mixture.

Figure 2:
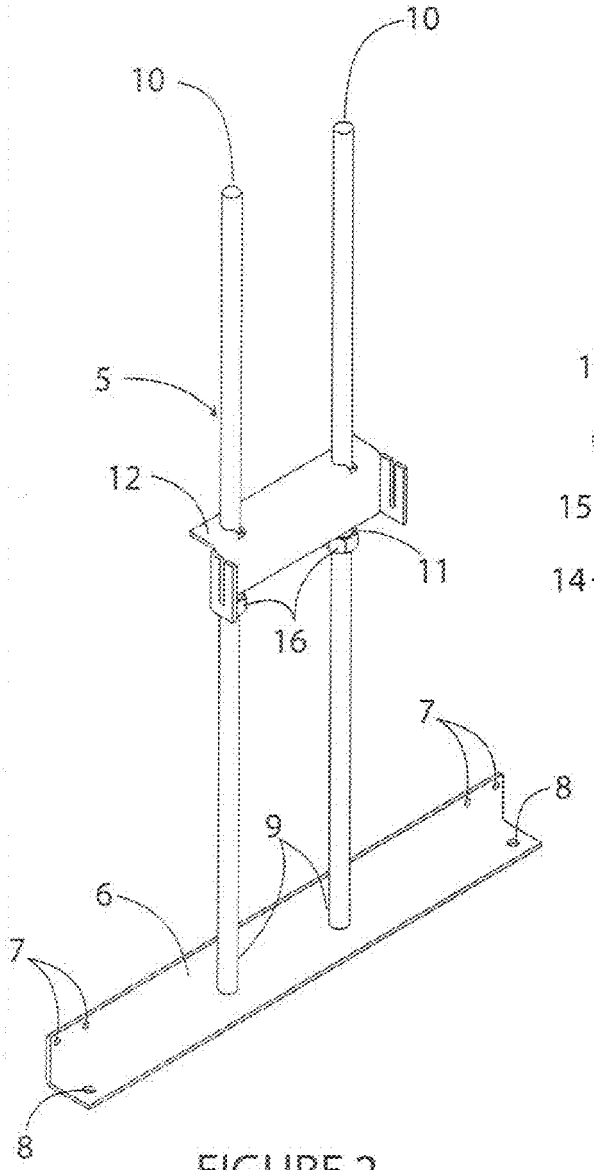
FIG. 2 is a simplified perspective view of the transverse wall form support showing the base element.

FIG. 2 is a simplified fragmented perspective view of the transverse wall form support (5) used to support the wall form assembly (19). The base element (6) is manufactured from 1½ angle iron about ⅛" thick and typically about 16" in length. In the lower leg in contact with the ground is a hole (8) about ⅜" in diameter into which a spike would be driven into the ground to hold the wall form support in position. Smaller holes (7) in the upright flange of the base element are used to attach the longitudinal reinforcing steel for the footing in position. As engineers usually require the steel to be 1½" above the ground, the base element provides the correct height.

In this preferred embodiment, pairs of threaded shaft elements (10) are weld-attached (9) to the base element (6) in a vertically oriented direction. The threaded shaft elements are typically ½" diameter coil rods with about six threads per inch to allow for rapid height adjustment. A threaded element (16), typically a ½" coil nut is threaded down each coil rod before placing a sleeve element (11) which is a small pipe about 2" long with a ½" internal diameter to slide over the coil rod and sit on the top of the coil nut. This sleeve element keeps the form tie support means (12) away from the threads of the coil rod, aiding in the height adjustment process.

Figure 3:
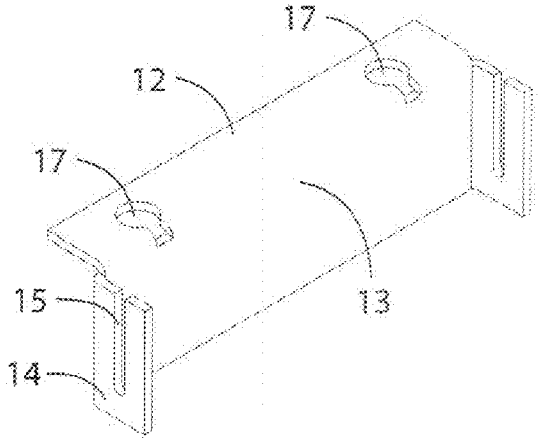
FIG. 3 is a simplified perspective view of the form tie support means, shown separate from the transverse wall form support.

FIG. 3 is a simplified fragmented perspective view of the form tie support means (12) which supports the form tie means (24) of the ICF block. This form tie support means has a form tie angle means (13) which provides a vertical face where from either end there are extension means (14) bent at right angles to form tabs into which are stamped slots (15) for receiving and supporting form tie means (24) of the ICF block. The width of this slot is slightly larger than the thickness of the form tie means (24) so that the block is supported properly in a horizontal position. Two holes (17) are stamped into the top face of the form tie support means, with a diameter slightly larger than the ½" coil rod.

Figure 4:
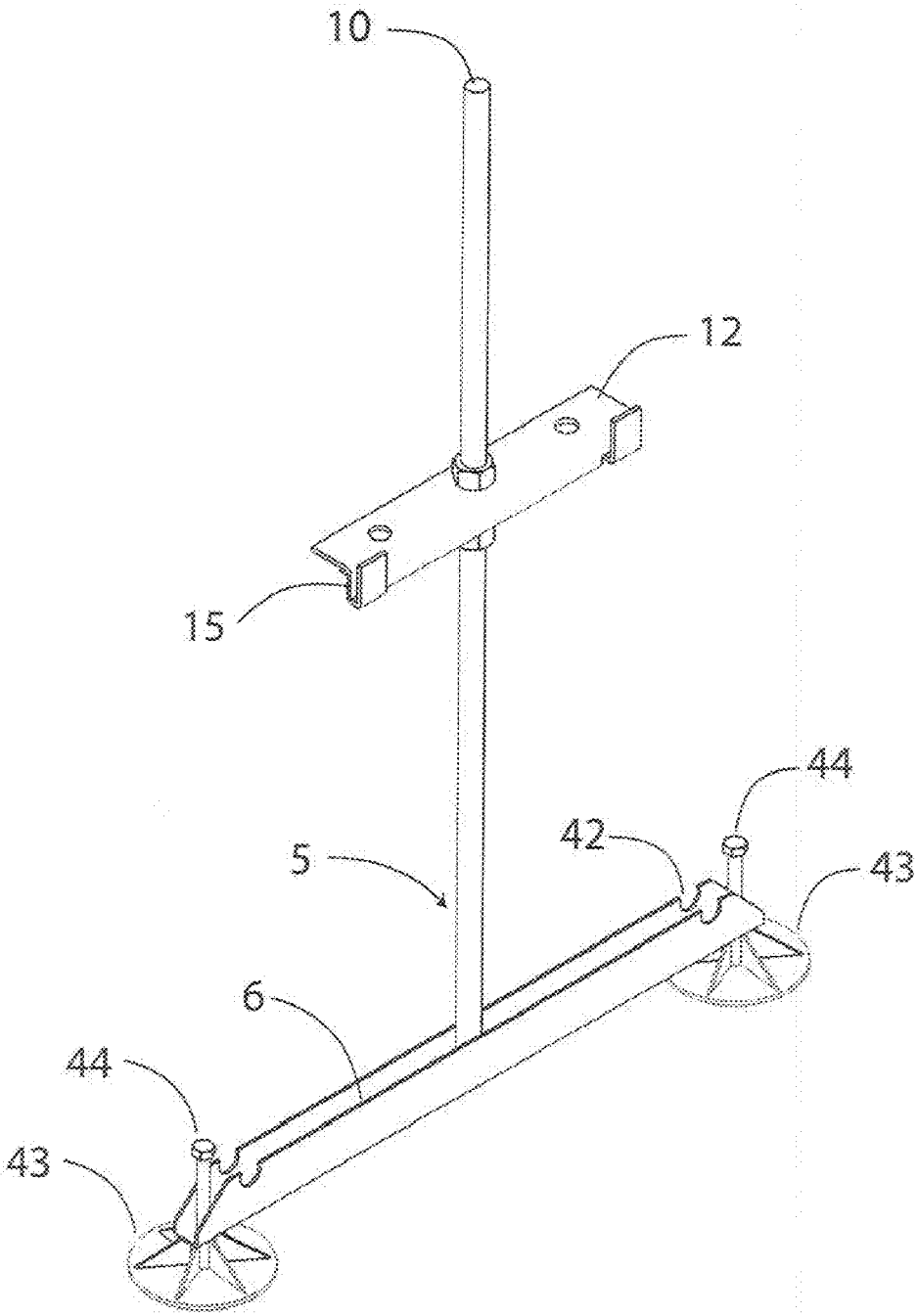
FIG. 4 is a simplified perspective view of a second embodiment of the transverse wall form support.

FIG. 4 is a simplified fragmented perspective view of a second embodiment of the transverse wall form support (5) which supports the form tie means (24) of the ICF block. In this second embodiment, the base (6) now takes a U-profile, with slots (42) in the top edge to receive the footing reinforcing steel. Feet pad elements (43), with a 2½" diameter, are adjustable up and down with bolts (44) to make the coil rod vertical. This embodiment has a single threaded shaft element (10) instead of a pair as shown in FIG. 2 which does not provide as much stability. This embodiment does not have the same surface area on the feet pads as with the preferred embodiment base angle and may experience ground settlement.

In this second embodiment the connection between the ICF block (19) and the transverse wall form support (5) is the slot (15) in the form tie support means (12) which supports the web (24) of the ICF block above the ground at the footing (4) height. The height adjustment of the block above the ground (3) is obtained by adjusting the nut (16) on the threaded shaft (10).

Figure 5:
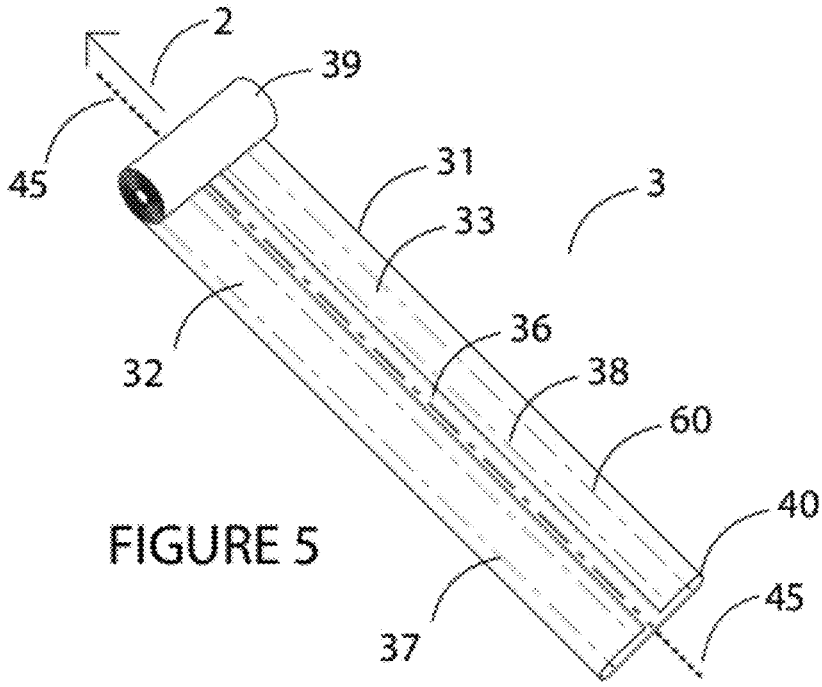
FIG. 5 is a simplified perspective view of a roll of the flexible sheet form element showing the edge portions folded into the center portion.

FIG. 5 is a simplified fragmented perspective view of the flexible sheet form element (31) which forms the concrete footing under the wall assembly. Typically the flexible sheet form element (31) is C-folded (40) where the edge portions are folded in to meet at the centerline (36). The C-folding makes the roll (39) easier to handle on the job site. The centerline (36) on the fabric is rolled out over the spray painted line (45) on the ground so that the fabric centerline is in line with the longitudinal foundation axis (2).

Figure 6:
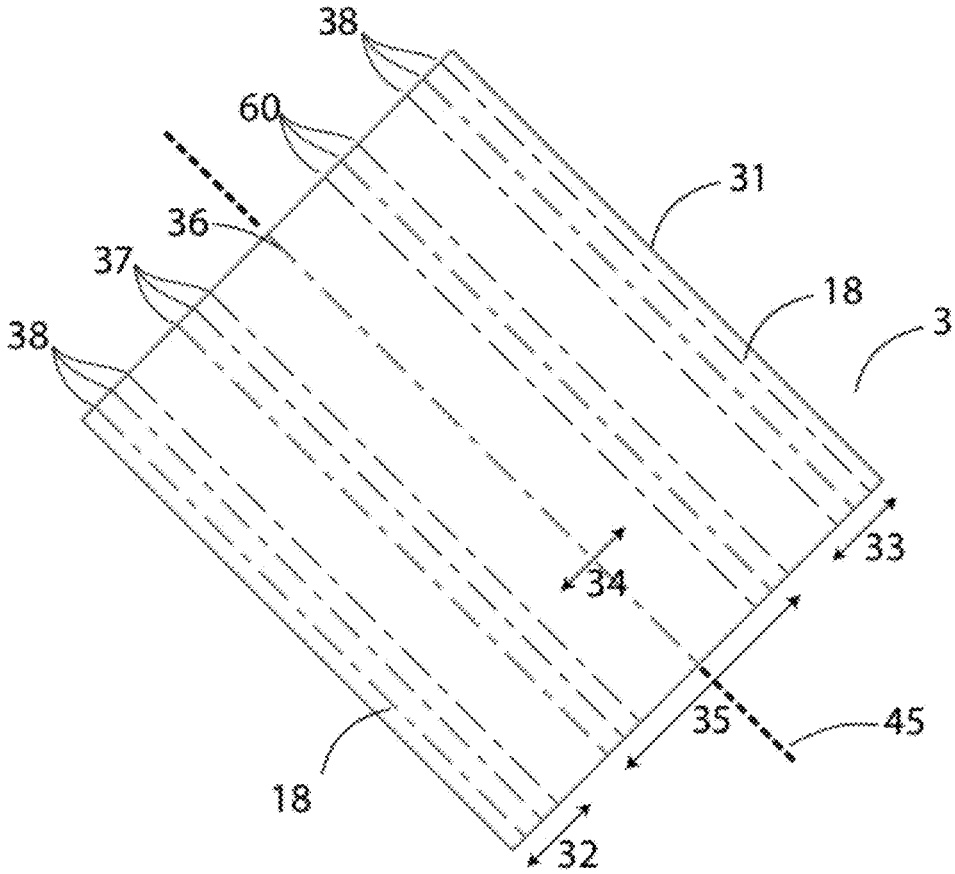
FIG. 6 is a simplified perspective view of a roll of the flexible sheet form element showing the edge portions unfolded to lay flat on the ground.

FIG. 6 is a simplified fragmented perspective view of the flexible sheet form element (31) which has now been unfolded to show the different lines printed on the fabric. The typical width of the fabric is 62" which can form a footing of width 24" and height of 12". The centerline (36) is printed along the longitudinal center of the fabric so that the distance to each longitudinal edge is equal. There are four longitudinal portions on the unfolded flexible sheet form element (31). The center portion (34) is located in the center of the fabric, with about 6" on either side of the centerline (36). The edge portions (32, 33) are located on the interior and exterior outside edges of the fabric respectively. The contact portion (35) is the width of the fabric which is in contact with the ground when the fabric has been attached to the wall form and is filled with concrete.

The external and internal footing width lines (37, 60) are located such that if the hand is placed on the (for example) 24" line, and the fabric is snugly attached to the bottom edge of the ICF block, then the contact width (35) will be 24" with the ground. The actual location of the footing width line is not 12" from the centerline 36 as the width line (37 or 60) must take into account the bulge of the fabric as well as other factors. As it is laborious to bend over and adjust the fabric using the footing width lines, there is a second set of lines, edge lines (38) which enable the forming contractor to locate the fabric without having to bend over constantly.

Line dots (18) are printed on the centerline (36), footing width lines (37, 60) and edge lines (38) about 14" on center so that during installation the edge portion (32, 33) is aligned in line with the line dots on the centerline. These line dots measure the longitudinal distance along the fabric which prevents wrinkles occurring in the fabric.

Figure 7:
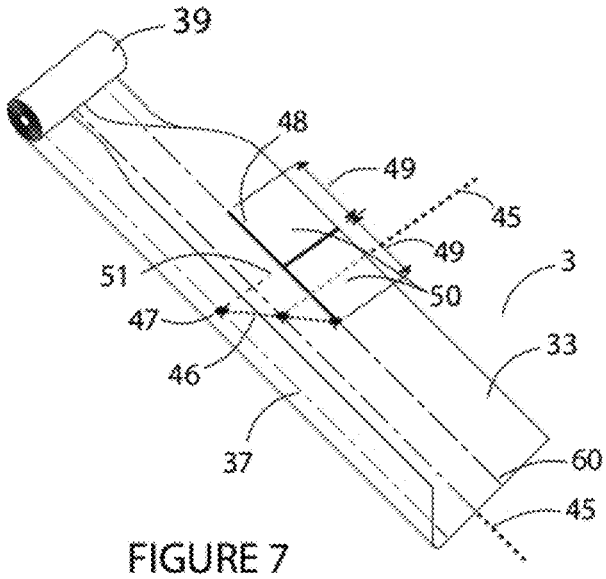
FIG. 7, 8, 9 are simplified perspective views which show the method of folding and cutting the flexible sheet form element around a right angled corner.
Figure 8:
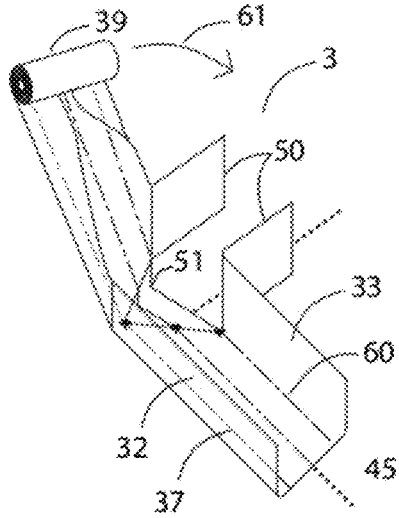
Figure 9:
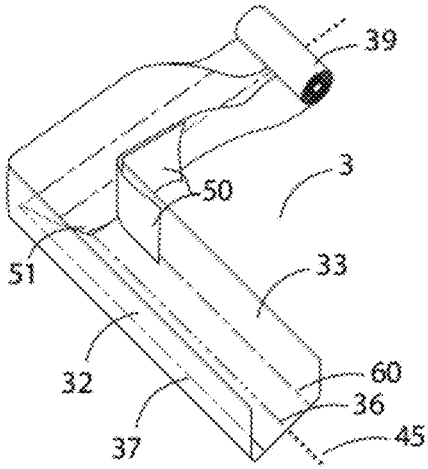

FIGS. 7, 8 & 9 are simplified fragmented perspective views of the flexible sheet form element (31) which show the three steps of cutting and folding the fabric around a ninety degree corner. FIG. 7 shows how the fabric roll (39) is unrolled past the corner and the C-folds (40) unfolded onto the ground in the region of the corner. A corner diagonal line (46) is envisaged 45 degrees from the longitudinal axis (2) passing through the intersection of the two painted lines (45). Three nails (47) are hammered through the diagonal into the ground to hold the fabric in place. The first nail is directly over the corner of the sprayed ground line. The second is at the intersection of the external footing width line (37) and the diagonal; and the third is at the intersection of the internal footing width line (60) with the diagonal.

Two corner tabs (50) are created by cutting an inverted 'T' on the interior edge portion (33), with the upright of the 'T' in line with the nail over the outside footing width line (37). The top of the 'T' is cut along the interior footing width line (60) a distance equal to the distance between the two footing width lines (49). The fabric is cut in the opposite direction a similar distance (49). The fold point (51) is lifted up, and the roll (39) swung in the new direction as shown by the direction arrow (61). The roll is laid in the new direction, and the fold point (51) nailed to the ground beside the exterior footing width line (37).

Figure 10:
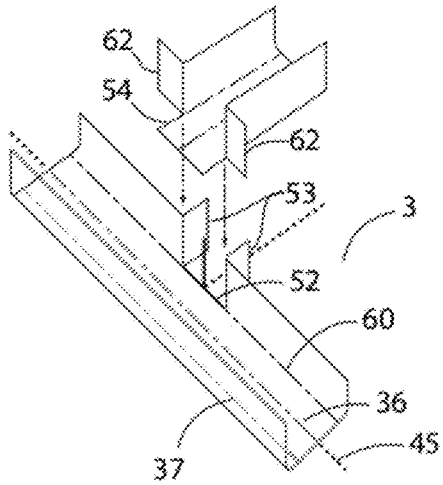
FIG. 10 is a simplified perspective view showing how to cut and fold an intersecting footing junction.

FIG. 10 is a simplified fragmented perspective view of the flexible sheet form element (31) and the method used for cutting and folding a T-junction. An inverted 'T' (52) is cut on the edge portion of the through fabric, with the length of the 'T' equal to the distance between the two fabric width lines (37, 60), thereby forming junction tabs (53). On the intersecting fabric, cuts (54) are made up the footing width lines (37, 60) a distance equal to the distance between the footing width line (37) and the centerline (36).

Figure 11:
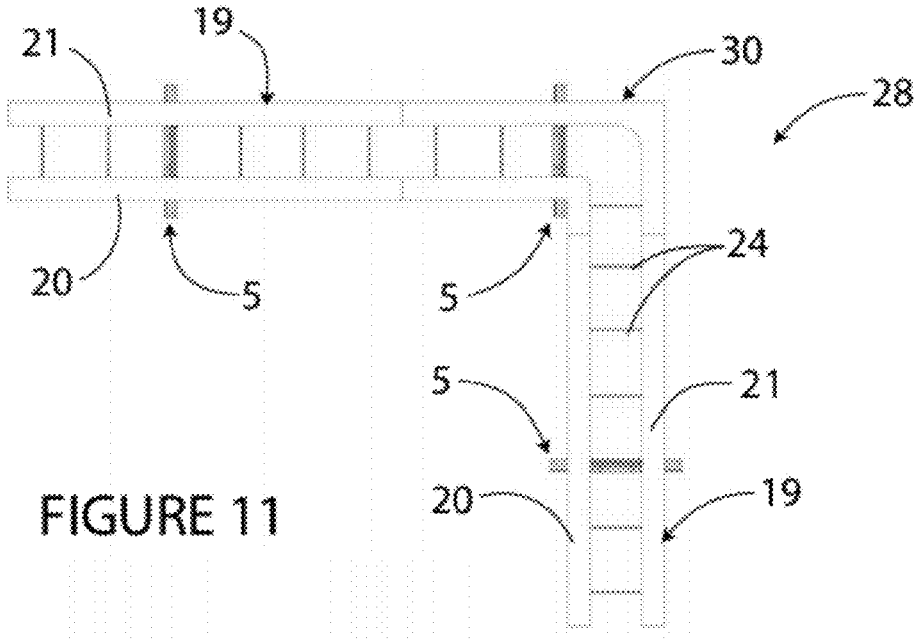
FIG. 11 is a simplified plan view showing the corner section of three wall form assemblies, including transverse wall form supports.

FIG. 11 is a simplified fragmented plan view of a corner section (28) of a foundation wall, simplified by not showing the fabric. The corner section (28) comprises wall form assemblies (19, 19) and one corner wall form assembly (30). The corner wall form assembly is similar to the wall form assembly (19) in that it has inner and outer wall form means (20, 21) and form tie means (24) to hold the two insulated panels equidistance from each other. However the corner block incorporates a corner (either 90 or 45 degrees) so as to produce a change in direction in the wall form. The size of a typical corner block is 16" in one direction and 32" in the longer direction. The vertical ends of the panels (20, 21) are foam-glued together to form a corner section that is 64" long in one direction, and 80" long in the other direction. The foam glue is commonly used in the industry, with the joint being as strong as the foam block itself. The advantage of gluing the blocks together is that it is much simpler to set them up in the wall form supports. In this embodiment there are three wall form supports (5), one as close to the corner as possible, and the other supports are in three form tie means (24) from the ends of the wall form assembly (19). It is much simpler to adjust the height of the blocks when they are glued together as described.

Figure 12:
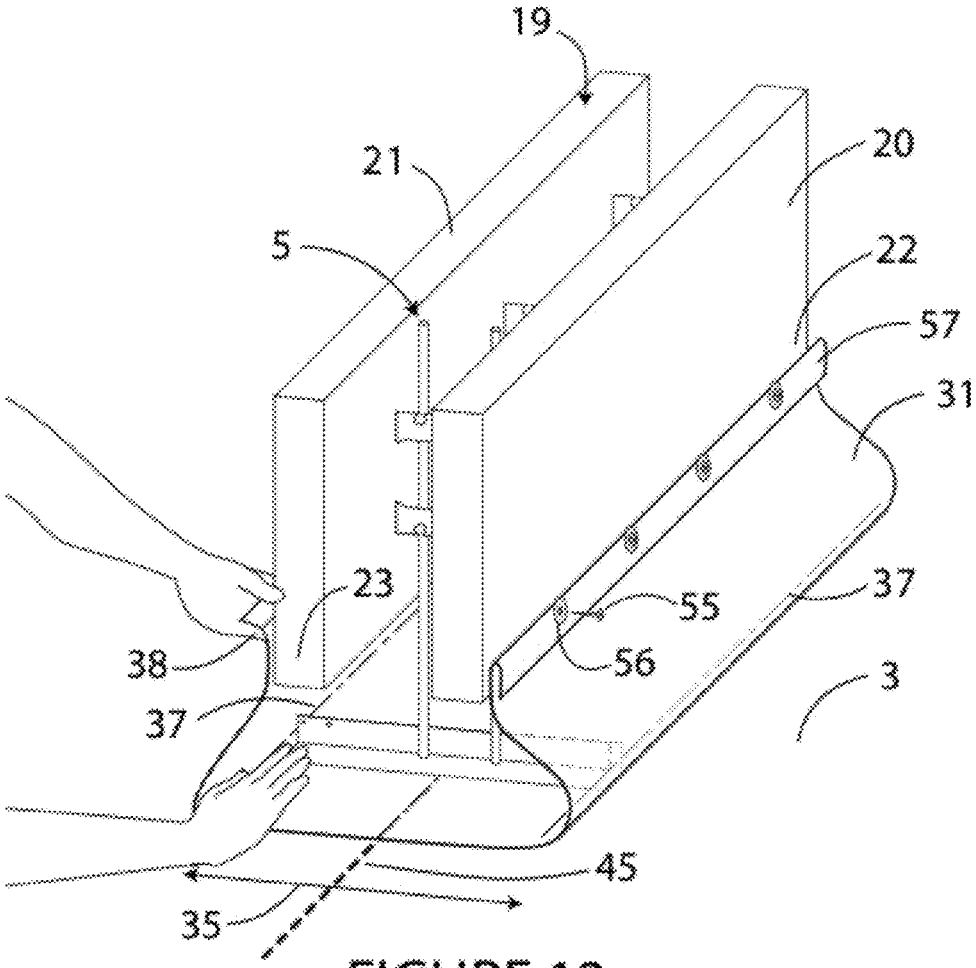
FIG. 12 is a simplified perspective view showing the exterior edge portion of the flexible sheet form element being positioned and attached to the lower edge portion of the wall form assembly.

FIG. 12 is a simplified fragmented perspective view of the building foundation form apparatus which shows the method of attaching the fabric (31) to the lower edges (32, 33) of the wall form assembly (19). As shown, the left hand lifts the exterior edge portion (32) of the fabric up to the exterior lower edge portion (23) of the ICF block. The right hand holds the footing width line (37) on the ground thereby obtaining the correct positioning of the fabric to achieve the desired contact width (35) for that concrete footing. The extra fabric is folded over (57), and the double thickness fabric attached to the lower edge portion by using 1½" screws (55) and 1" fender washers (56). The foam itself has very little strength, but the form tie means (24) run through the wall form means (20, 21) to the outside surface. It is important that the screw to attach the fabric is attached to the form tie means itself.

Figure 13:
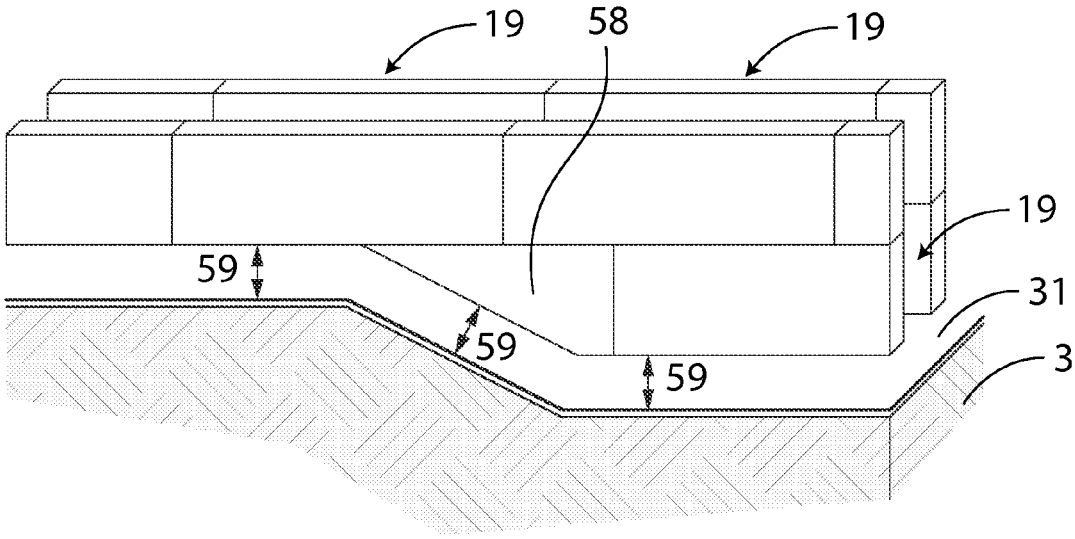
FIG. 13 is a simplified perspective view of a straight wall section showing the method of cutting the wall form assembly to conform to a change in elevation.

FIG. 13 is a simplified fragmented perspective view of the building foundation form apparatus where a change in grade in the excavation occurs. Typically changes in elevation are made in multiples of the height of the block, which is normally 16". The ICF block adjacent to the grade change (58) is cut on the same angle as the bank so that the footing height (59) is maintained. This method is very much simpler to install than with conventional footings where bulkheads are required, and this method uses much less concrete.

Therefore, while the presently preferred form of the system has been shown and described, and several modifications thereof discussed, persons skilled in this art will readily appreciate that various additional changes and modifications may be made without departing from the spirit of the invention, as defined and differentiated by the following claims.

The invention claimed is:

1. A monopour form comprising:

a. a flexible sheet form element having edge portions that are longitudinally extending and a transverse spacing between the edge portions defining a flexible sheet form element width having a contact portion between the edge portions supported directly on a ground surface and aligned along a longitudinal foundation axis;

b. a first transverse wall form support and a second transverse wall form support supported directly on the flexible sheet form element, wherein the first transverse wall form support and the second transverse wall form support are longitudinally spaced apart along the longitudinal foundation axis as well as centered over the longitudinal foundation axis, and wherein each of the transverse wall form supports further comprises at least one base element supported directly on the contact portion of the flexible sheet form element and centered over the longitudinal foundation axis, at least one vertically oriented threaded shaft element permanently affixed to the base element, at least one form tie support means positioned by the threaded shaft element, and at least one internally threaded element aligned around the threaded shaft element to position and support the form tie support means;

c. a plurality of longitudinal wall form assemblies centered over the longitudinal foundation axis, wherein the plurality of longitudinal wall form assemblies comprise a rigid inner form means and rigid outer form means, wherein the rigid inner form means and rigid outer form means are interconnected by at least one form tie means wherein the rigid inner form means and the rigid outer form means both have a lower edge portion;

d. a connection between the plurality of longitudinal wall form assemblies and the first transverse wall form support and the second transverse wall form support such that the plurality of longitudinal wall form assemblies are raised above the ground surface; and e. a securing between edge portions of the flexible sheet form element and the lower edge portions of the rigid inner form means and the rigid outer form means, wherein the plurality of longitudinal wall form assemblies at least partially support the flexible sheet form element, a portion of the flexible sheet form element also rests on the ground surface to form a U-shape.

* * * * *